US008487971B2

(12) United States Patent
Yahata et al.

(10) Patent No.: US 8,487,971 B2
(45) Date of Patent: Jul. 16, 2013

(54) ERASING APPARATUS, PAPER POST-PROCESSING APPARATUS, IMAGE FORMING AND ERASING APPARATUS, AND IMAGE ERASING METHOD IN THE ERASING APPARATUS

(75) Inventors: Isao Yahata, Shizuoka (JP); Ken Iguchi, Shizuoka (JP); Takahiro Kawaguchi, Shizuoka (JP); Hiroyuki Taguchi, Shizuoka (JP); Hiroyuki Tsuchihashi, Shizuoka (JP); Hiroyuki Taki, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 321 days.

(21) Appl. No.: 13/038,328

(22) Filed: Mar. 1, 2011

(65) Prior Publication Data

US 2011/0211033 A1 Sep. 1, 2011

Related U.S. Application Data

(60) Provisional application No. 61/312,092, filed on Mar. 9, 2010.

(51) Int. Cl.
*B41J 2/32* (2006.01)

(52) U.S. Cl.
USPC ..... 347/179; 347/101; 347/171

(58) Field of Classification Search
USPC ..... 347/101, 171, 179
See application file for complete search history.

(56) References Cited

U.S. PATENT DOCUMENTS

| | | | | |
|---|---|---|---|---|
| 8,077,191 | B2 * | 12/2011 | Brewington et al. | 347/171 |
| 8,177,347 | B2 * | 5/2012 | Brewington et al. | 347/101 |
| 8,308,262 | B2 * | 11/2012 | Yoshida et al. | 347/14 |
| 2007/0165094 | A1 * | 7/2007 | Matsumura et al. | 347/223 |
| 2010/0272449 | A1 | 10/2010 | Yoshida et al. | |
| 2011/0317198 | A1 * | 12/2011 | Suzuki | 358/1.13 |

* cited by examiner

*Primary Examiner* — Huan Tran
(74) *Attorney, Agent, or Firm* — Patterson & Sheridan, L.L.P.

(57) ABSTRACT

According to one embodiment of the present invention, an erasing apparatus includes a used sheet stacking tray, an image erasing unit, a stand-by tray, a stand-by tray driving unit, and an erased sheet stacking tray. The used sheet stacking tray stacks thereon a used sheet on which an image is formed using an erasable colorant of which a color is erased by a predetermined heating process. The image erasing unit performs the heating for the used sheet which is received one by one from the used sheet stacking tray and discharges an erased sheet from which the image formed on the used sheet is erased. The stand-by tray has a mechanism which can be driven in a predetermined direction and places thereon the erased sheet discharged by the image erasing unit. The stand-by tray driving unit drives the stand-by tray and enables the erased sheet to free-drop. The erased sheet stacking tray is disposed under the stand-by tray and stacks thereon the erased sheet which free-drops from the stand-by tray.

20 Claims, 8 Drawing Sheets

FIG. 6

| SPEED | ATTACHMENT OR NON-ATTACHMENT BETWEEN STACKED SHEETS | |
|---|---|---|
| | NONUSE OF ACTIVE DROP | USE OF ACTIVE DROP |
| 75cpm | OK | OK |
| 70cpm | OK | OK |
| 65cpm | NG | OK |
| 60cpm | NG | OK |
| 55cpm | NG | OK |
| 50cpm | NG | OK |
| 45cpm | NG | OK |
| 40cpm | NG | OK |
| 35cpm | NG | OK |

※ OK : NON-ATTACHMENT
NG : ATTACHMENT

ERASING APPARATUS, PAPER POST-PROCESSING APPARATUS, IMAGE FORMING AND ERASING APPARATUS, AND IMAGE ERASING METHOD IN THE ERASING APPARATUS

CROSS-REFERENCE TO RELATED APPLICATIONS

This application is based upon and claims the benefit of priority from Provisional U.S. Application No. 61/312,092, filed on 9 Mar., 2010, the entire contents of which are incorporated herein by reference.

FIELD

Embodiments described herein relate generally to an erasing apparatus, a paper post-processing apparatus, an image forming and erasing apparatus, and an image erasing method in the erasing apparatus.

BACKGROUND

In the related art, in order to reuse paper on which an image is formed by an image forming apparatus such as an MFP (Multi Function Peripheral), printing is performed on paper using an erasable colorant of which a color is erasable, such as ink including leuco dye. In addition, an erasing apparatus causes a chemical reaction by heating paper on which printing was performed using an erasable colorant in the image forming apparatus, erases a color of the erasable colorant therefrom and then stacks it on a paper discharge tray.

However, in the erasing apparatus in the related art, there is a possibility that attachment between adjacent sheets of paper may occur since paper from which an image is erased is stacked in a state where the temperature thereof is high.

BRIEF DESCRIPTION OF THE DRAWINGS

FIG. 6 is a diagram illustrating an effect achieved by the stand-by tray shown in FIG. 1.

DETAILED DESCRIPTION

According to one embodiment of the present invention, an erasing apparatus includes a used sheet stacking tray, an image erasing unit, a stand-by tray, a stand-by tray driving unit, and an erased sheet stacking tray.

The used sheet stacking tray stacks thereon a used sheet on which an image is formed using an erasable colorant of which a color is erased by a predetermined heating process. The image erasing unit that performs the heating for the used sheet which is received one by one from the used sheet stacking tray and discharges an erased sheet in which the image formed on the used sheet is erased.

The stand-by tray has a mechanism which can be driven in a predetermined direction and that places thereon the erased sheet discharged by the image erasing unit. The stand-by tray driving unit drives the stand-by tray and enables the erased sheet to free-drop. The erased sheet stacking tray is disposed under the stand-by tray and stacks thereon the erased sheet which free-drops from the stand-by tray.

First Embodiment

Figure 1:
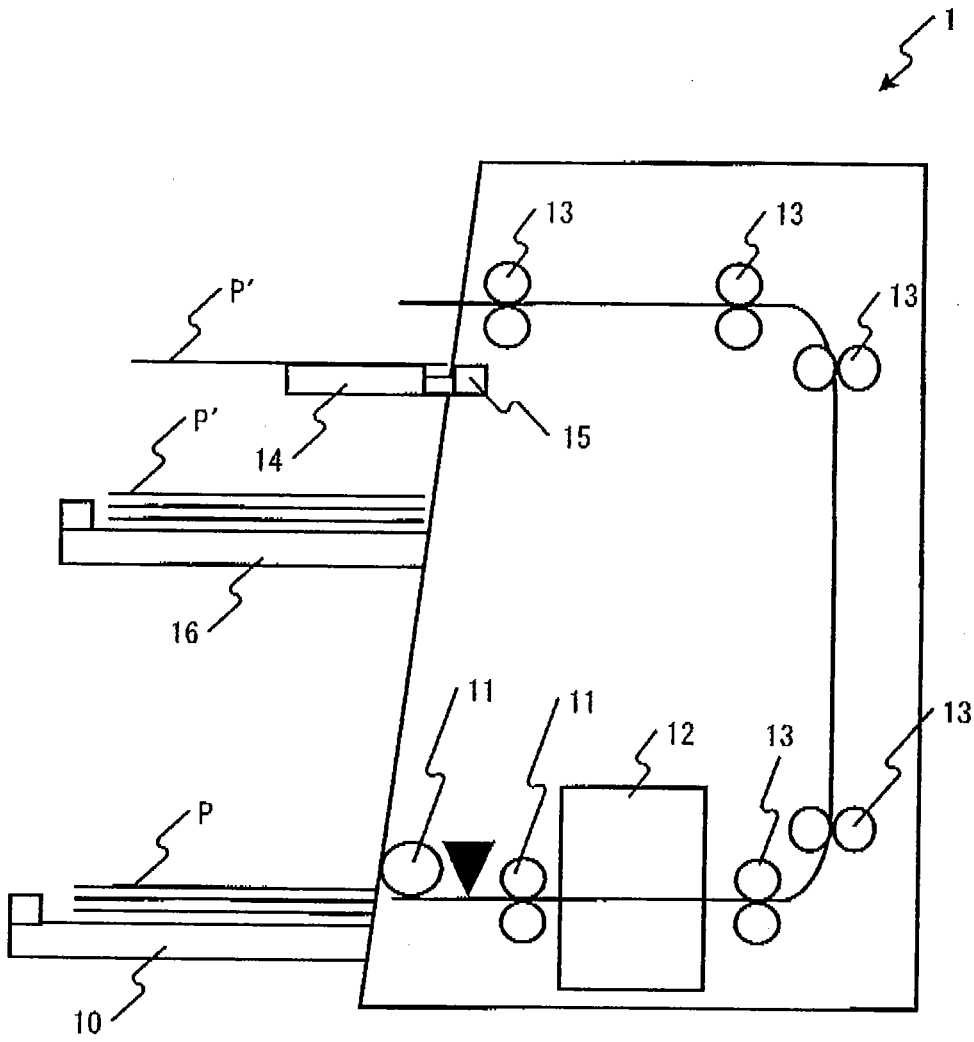
FIG. 1 is a schematic configuration diagram of an erasing apparatus according to a first embodiment of the present invention.

Hereinafter, the first embodiment of the present invention will be described with reference to FIGS. 1 to 7. FIG. 1 is a schematic configuration diagram of an erasing apparatus according to the first embodiment of the present invention.

As shown in the same figure, the erasing apparatus 1 includes a used sheet stacking tray 10, used sheet carrying rollers 11, an image erasing unit 12, erased sheet carrying rollers 13, a stand-by tray 14, and an erased sheet stacking tray 16.

The used sheet stacking tray 10 is a tray which stacks thereon a sheet (hereinafter, referred to as a "used sheet P") on which an image is formed using an erasable colorant of which a color is erasable by a predetermined heating treatment.

The used sheet carrying rollers 11 carry the used sheet P stacked on the used sheet stacking tray 10 to the image erasing unit 12.

The image erasing unit 12 heats the used sheet P which is received one by one from the used sheet stacking tray 10, and discharges a sheet (hereinafter, referred to as an "erased sheet P'") from which the image formed on the used sheet P is erased.

The erased sheet carrying rollers 13 carry the erased sheet P' discharged by the image erasing unit 12 to the stand-by tray 14.

Figure 2:
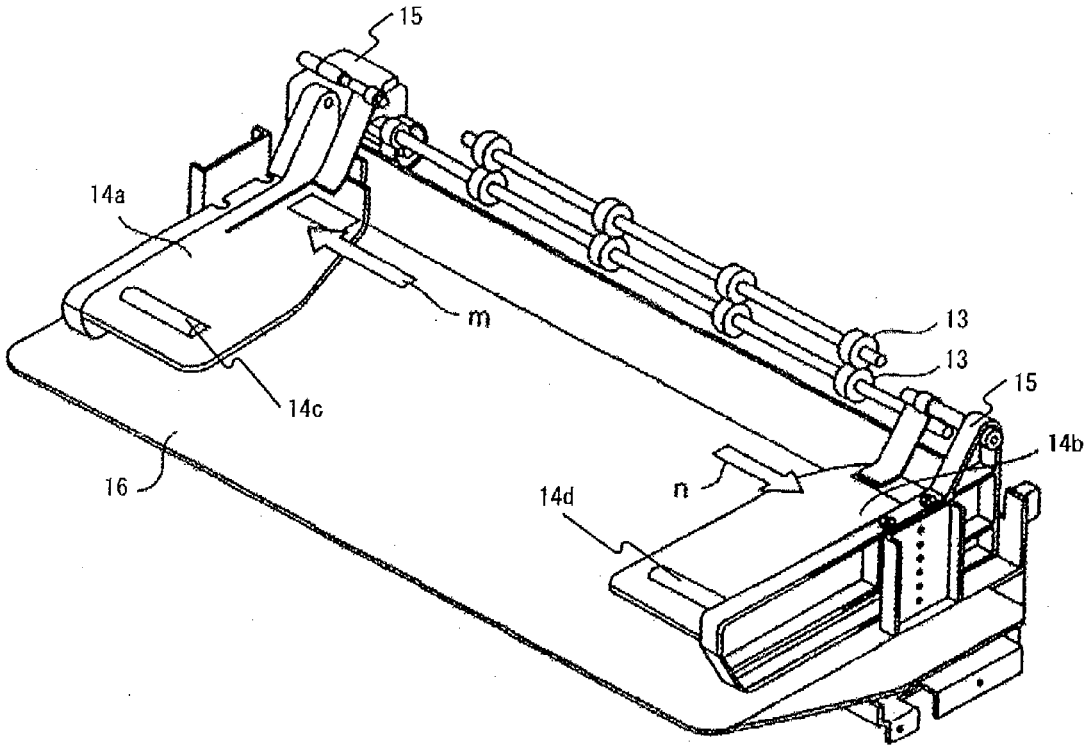
FIG. 2 is an enlarged diagram of the erasing apparatus shown in FIG. 1.

The stand-by tray 14 has a tray driving mechanism 15 which can be driven in a predetermined direction, and places the erased sheet P' discharged by the image erasing unit 12 thereon. FIG. 2 is an enlarged view of main parts of the erasing apparatus shown in FIG. 1. As shown in the same figure, the stand-by tray 14 in this embodiment includes a pair of tray members 14*a* and 14*b* which is respectively formed extending from the vicinities of the left end and the right end of the sheet discharge portion to the discharge direction. In addition, the tray driving mechanism 15 is installed so as to drive a pair of tray members 14*a* and 14*b* in the transverse direction, but may enable a pair of tray members 14*a* and 14*b* to rotate in the longitudinal direction by using support portions 14*g* and 14*h* as axes.

The erased sheet stacking tray 16 is disposed under the stand-by tray 14, receives and stacks the erased sheet P' which free-drops from the stand-by tray 14 thereon.

Figure 3:
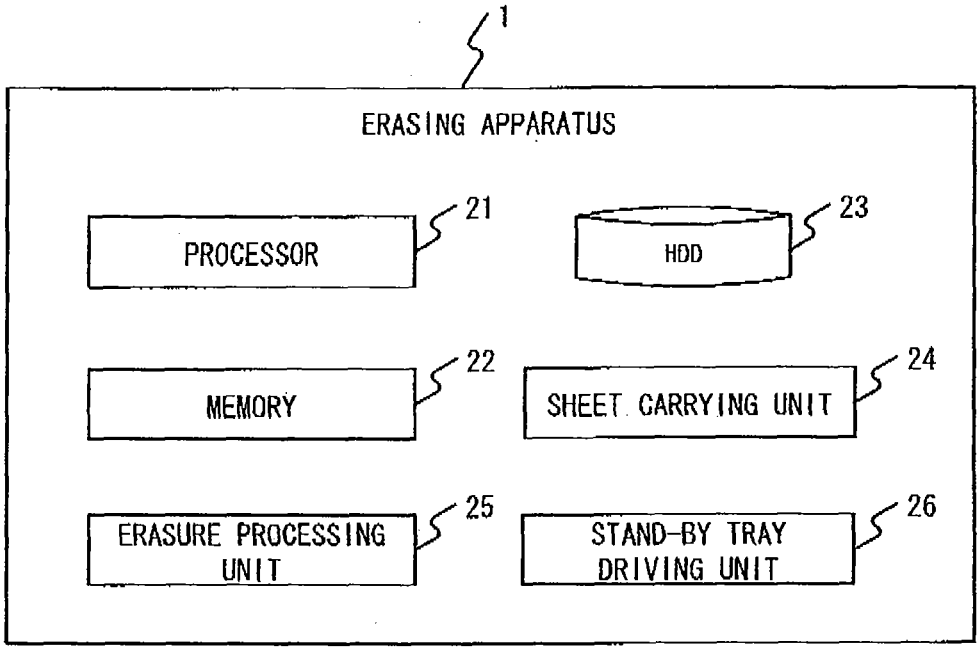
FIG. 3 is a block diagram illustrating a configuration example of hardware and software of the erasing apparatus shown in FIG. 1.

FIG. 3 is a block diagram illustrating a hardware and software configuration example of the erasing apparatus shown in FIG. 1. As shown in the same figure, the erasing apparatus 1 includes a processor 21, a memory 22, an HDD 23, a sheet carrying unit 24, an erasure processing unit 25, a stand-by tray driving unit 26.

The processor 21 is a control apparatus which develops various kinds of programs stored in the HDD 23 in the memory 22 in response to an input or the like from an operation panel (not shown), and performs an erasing process for erasing an image formed on the used sheet P. The processor 21 may use a CPU (Central Processing Unit), an MPU (Micro Processing Unit) capable of executing operation processes equivalent to the CPU, or the like.

The memory 22 is a main storage apparatus in which various kinds of programs performing processes in the erasing apparatus 1 are developed. The memory 22 may include, for example, RAM (Random Access Memory), ROM (Read Only Memory), DRAM (Dynamic Random Access Memory), SRAM (Static Random Access Memory), VRAM (Video RAM), a flash memory, or the like.

The HDD 23 is an auxiliary storage apparatus which stores various kinds of programs enabling erased sheets to be carried, driving the stand-by tray 14, and the like, and environment information in the erasing apparatus 1. In addition, in this embodiment, the HDD is exemplified as an auxiliary storage apparatus, which is not limited thereto, and, for example, it may use a flash memory, SSD (Solid State Drive), a magnetic disc, or the like other than the HDD.

The sheet carrying unit 24 is a control program which controls rotation driving of the used sheet carrying rollers 11 and the erased sheet carrying rollers 13 and enables sheets to be carried, based on commands from the processor 21. The erasure processing unit 25 is a control program enables the image erasing unit 12 to perform erasure process based on commands from the processor 21.

The stand-by tray driving unit 26 is a control program which enables the pair of tray members 14*a* and 14*b* of the tray driving mechanism 15 to slide in the transverse direction and thus the erased sheet P' to free-drop on the erased sheet stacking tray 16, based on commands from the processor 21.

In addition, the stand-by tray driving unit 26 controls the pair of tray members 14*a* and 14*b* to be driven after the erased sheet P' is stacked on the stand-by tray 14 and then a predetermined time has elapsed.

A waiting time after the erased sheet P' is stacked until the pair of tray members 14*a* and 14*b* begins to be driven, that is, an open cooling time of the erased sheet P' is set to a time for which a sheet temperature is reduced to a predetermined temperature where sheets are not attached to each other, in order to prevent attachment between sheets. The open cooling time is preferably set in advance in consideration of a sheet carrying speed in the erasing apparatus 1, a measured value of a sheet temperature when the sheet is discharged to the stand-by tray 14, occurrence or non-occurrence of the attachment, and the like.

Next, an operation of the erasing apparatus 1 configured as described above will be described.

First, if an erasing request is input from a user through pressing of an operation input button (not shown), the processor 21 activates the sheet carrying unit 24, rotatably drives the used sheet carrying rollers 11, extracts the used sheets P stacked on the used sheet stacking tray 10 one by one, and carries the used sheet P to the image erasing unit 12.

Next, the processor 21 activates the erasure processing unit 25, makes the image erasing unit 12 perform the erasing process for the used sheet P so as to be discharged as the erased sheet P'. The image erasing unit 12 heats the used sheet P at a predetermined temperature so as to erase an image on the used sheet P, formed using an erasable colorant.

Figure 4:
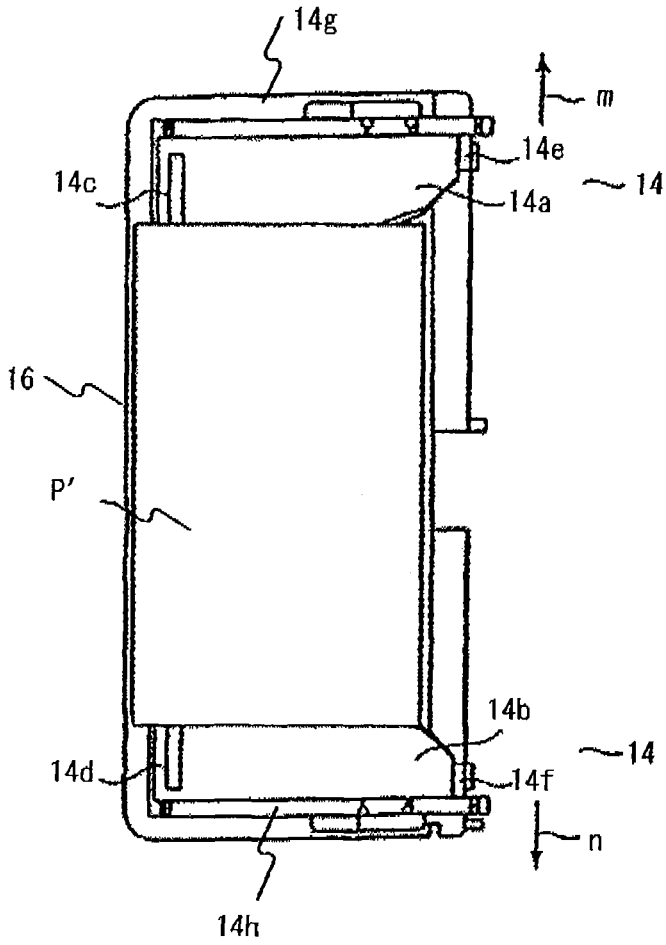
FIG. 4 is a plan view illustrating a state where a used sheet is stacked on a stand-by tray shown in FIG. 1.

Then, the processor 21 activates the sheet carrying unit 24, rotatably drives the erased sheet carrying rollers 13, and carries the erased sheet P' from the image erasing unit 12 to the stand-by tray 14. FIG. 4 is a plan view illustrating a state where the erased sheet P' is placed on the stand-by tray 14 shown in FIG. 1-I*f* one erased sheet P' is stacked on the stand-by tray 14, the pair of tray members 14*a* and 14*b* is opened by the driving mechanism of the stand-by tray in the transverse direction, and thus the erased sheet P' drops on the erased sheet stacking tray 16 due to the self weight. Hereinafter, this action is referred to as "active drop". In addition, when the pair of tray members 14*a* and 14*b* begins to be slid open, since the pair of tray members 14*a* and 14*b* has the small area in the sheet rear end side and protrusions 14*c* and 14*d* are formed to protrude on the placing surfaces, the rear end side of the erased sheet P' first drops on the erased sheet stacking tray 16. Since the erased sheet P' drops from the rear end side thereof, there is an advantage in that the erased sheets P' are easily aligned.

Next, the processor 21 activates the stand-by tray driving unit 26, and if the erased sheet P' is placed on the stand-by tray 14 and then a constant time has elapsed, drives the pair of tray members 14*a* and 14*b* outwardly in the transverse direction, and makes the erased sheet P' free-drop towards the erased sheet stacking tray 16. In addition, the pair of tray members 14*a* and 14*b* moves so as to make the erased sheet P' free-drop, and thereafter returns to the home position so as to receive the erased sheet P' again.

Figure 5:
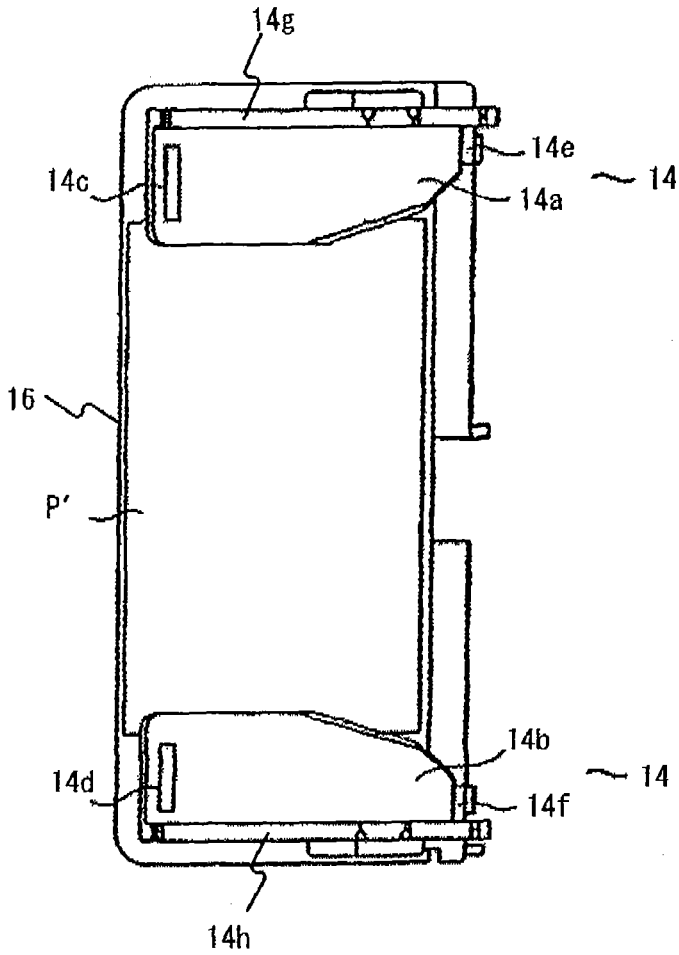
FIG. 5 is a plan view illustrating a state where an erased sheet is stacked on an erased sheet stacking tray shown in FIG. 1.

Further, the erased sheet stacking tray 16 receives the erased sheets P' which sequentially free-drop from the stand-by tray 14 and stacks them thereon. FIG. 5 is a plan view illustrating a state where sheets are stacked on the erased sheet stacking tray 16 shown in FIG. 1.

As such, according to the erasing apparatus 1 in this embodiment, the erased sheet from which an image is erased can be first placed on the stand-by tray 14 by the heating in the image erasing unit 12, and is stacked on the erased sheet stacking tray 16 after a sheet temperature is sufficiently decreased, thereby preventing attachment between the sheets. FIG. 6 is a table illustrating an effect achieved by the stand-by tray 14 shown in FIG. 1. Here, the table shows relationship between a discharging speed of the erased sheet P', attachment or non-attachment of the erased sheets F', and presence or absence of the active drop function. Hereinafter, a case where the discharging speed is 65 cpm or less, that is, the erasing apparatus 1 having the low discharging speed will be described as an example. In a case of the erasing apparatus 1 which does not have the active drop function, it is shown that the attachment between sheets occurs (FIG. 6: NG). This is because since the discharging speed is low, a sheet after the erasing is not sufficiently cooled, and the erased sheet P' is stacked on the erased sheet stacking tray 16 in a state where the sheet temperature thereof is high. In contrast, in a case where the erasing apparatus 1 has the active drop function, even when the discharging speed is the same, the erased sheet F' after the erasing is given a sufficient open cooling time, and thereby it is shown that attachment between sheets is prevented (FIG. 6: OK). In addition, in a case where the erasing apparatus 1 has the discharging speed of 70 cpm or more, since the sheet is cooled whilst being carried, the effect achieved by the presence or the absence of the active drop is not recognized, but the discharging speed of the erasing apparatus 1 which is generally used is about 50 cpm, and thus it is preferable to provide the active drop function.

Second Embodiment

Next, the second embodiment of the present invention will be described with reference to FIGS. 7 and 8. In addition, the same reference numerals are added to the same configurations as the configuration described in the first embodiment, and description thereof will be omitted.

Figure 7:
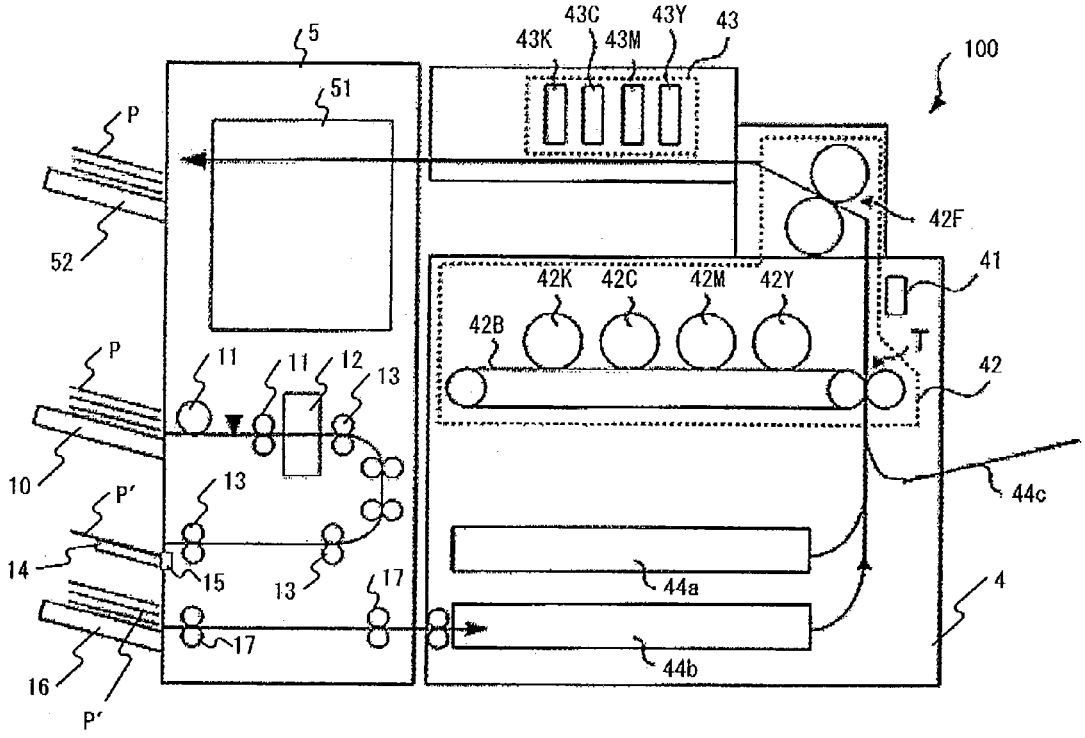
FIG. 7 is a schematic configuration diagram of an image forming and erasing apparatus according to a second embodiment of the present invention.

FIG. 7 is a schematic configuration diagram of an image forming and erasing apparatus 100 according to this embodiment. The image forming and erasing apparatus 100 includes an image forming apparatus 4 and a paper post-processing apparatus 5 which are integrally formed, and is an MFP (Multi Function Peripheral) which performs various processes such as an image reading process, an image forming process, and an image erasing process. The image forming and erasing apparatus 100 can perform two kinds of image forming processing modes, a first image forming processing mode (hereinafter, referred to as a "rewritable printing mode") using an erasable colorant of which a color disappears due to a chemical reaction when heated at a predetermined temperature and a second image forming processing mode (hereinafter, referred to as a "normal printing mode") using a non-erasable colorant of which a color does not disappear even when heated at the predetermined temperature. However, the rewritable printing mode can be performed even in a case of not aiming at the reuse of sheets.

In addition, the paper post-processing apparatus 5 includes the used sheet stacking tray 10, the used sheet carrying rollers 11, the image erasing unit 12, the erased sheet carrying rollers 13, the stand-by tray 14, and the erased sheet stacking tray 16, in the same manner as the erasing apparatus 1 in the first embodiment. In addition, the paper post-processing apparatus 5 also includes a sheet post-processing unit 51 which performs matching or stapling, a stacking tray 52 which stacks used sheets P discharged from the sheet post-processing unit 51, and reuse sheet carrying rollers 17 which receive the erased sheet F' from the erased sheet stacking tray 16 and carry it to the image forming apparatus 4 side as a reuse sheet.

Figure 8:
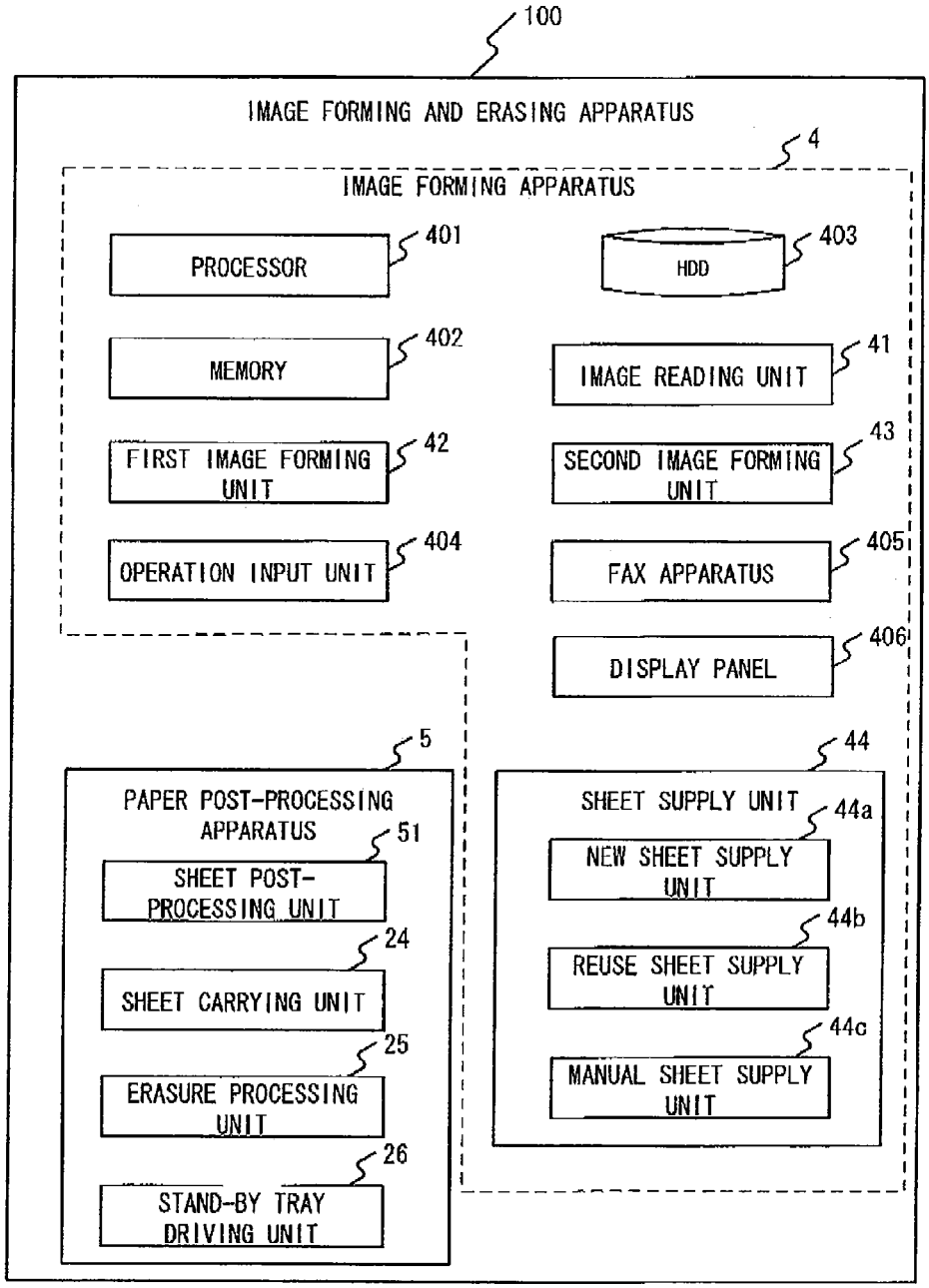
FIG. 8 is a block diagram illustrating a configuration example of hardware and software of the image forming and erasing apparatus shown in FIG. 7.

FIG. 8 is a block diagram illustrating a configuration example of hardware and software of the image forming and erasing apparatus 100 shown in FIG. 7. As shown in the same figure, the image forming and erasing apparatus 100 includes the image forming apparatus 4 and the paper post-processing apparatus 5 which are integrally formed. The image forming apparatus 4 side includes a processor 401, a memory 402, an HDD (hard disc drive) 403, an image reading unit 41, a first image forming unit 42 which forms an image using a non-erasable colorant, a second image forming unit 43 which forms an image using an erasable colorant, a sheet supply unit 44, an operation input unit 404, a facsimile apparatus 405, and a display panel 406.

The processor 401 performs various processes such as an image forming process or an image reading process, based on an image forming job or an operation input transmitted from a client terminal (not shown) which is connected thereto via a network or the operation input unit 404. The processor 401 in this embodiment controls the first image forming unit 42 to form an image on a sheet using image data obtained by an image forming job and a non-erasable colorant if an image is formed in the rewritable printing mode. In addition, the processor 401 controls the second image forming unit 43 to form an image using an erasable colorant if an image is formed in the normal printing mode. The processor 401 may use a CPU (Central Processing Unit), an MPU (Micro Processing Unit) capable of executing operation processes equivalent to the CPU, or the like.

The memory 402 stores programs for executing the respective processes in the image forming and erasing apparatus 100. In addition, the memory 402 temporarily stores image data generated by the image reading in the image forming process or is used as a work area of various applications. In addition, the memory 402 temporarily stores a signal for an image forming job obtained via a network or an operation input signal from the operation input unit 404. The memory 402 may include, for example, RAM (Random Access Memory), ROM (Read Only Memory), DRAM (Dynamic Random Access Memory), SRAM (Static Random Access Memory), VRAM (Video RAM), a flash memory, or the like.

The HDD 403 is an auxiliary storage apparatus which stores various kinds of information for the image forming and erasing apparatus 100. In addition, in this embodiment, the HDD 403 is exemplified as an auxiliary storage apparatus of the image forming and erasing apparatus 100, which is not limited thereto, and, for example, it may use a flash memory, SSD (Solid State Drive), a magnetic disc, or the like other than the HDD.

The operation input unit 404 performs operations such as designation of a copying condition or a scanning condition, or input of FAX numbers. The operation input unit 404 may include, for example, input key of figures or the like, a keyboard, a mouse, a touch panel, a touch pad, a graphics tablet, a dedicated button, and the like.

The image reading unit 41 is a typical image reading apparatus which is provided in a copier, an image scanner, or the like. The image reading unit 41 may be used when a document is copied or scanned using the image forming and erasing apparatus 100.

The first image forming unit 42 performs the normal printing mode in which an image is formed by a typical electrophotographic method. The first image forming unit 42 includes, as shown in FIG. 7, photoconductive drums 42K, 42C, 42M and 42Y, an intermediate transfer belt 42B, and a fixing apparatus 42F.

The photoconductive drums 42K to 42Y respectively form electrostatic latent images corresponding to the respective colors, black (K), cyan (C), magenta (M), yellow (Y), which constitute image data for forming an image, on photoconductive surfaces of the photoconductive drums 42K to 42Y, and form developer images which expose the electrostatic latent images using a developer (toner) supplied form a developing roller (not shown). The developer images formed on the photoconductive drums 42K to 92Y are transferred onto the intermediate transfer belt 42B (so called primary transfer).

The intermediate transfer belt 42B transfers the transferred developer images onto a image forming sheet (so-called secondary transfer) at the transfer position T shown in FIG. 7. The fixing apparatus 42F thermally fixes the developer images transferred to the sheet at the transfer position T to the sheet.

The second image forming unit 43 is a apparatus which performs the rewritable printing mode in which an image is formed by an ink jet type using erasable ink which is an erasable colorant. The second image forming unit 43 is provided with print heads 43K, 43C, 43M and 43Y respectively corresponding to erasable ink of black (K), cyan (C), magenta (M), and yellow (Y), and ejects ink from each print head, and forms an image using the erasable ink on a sheet.

Here, the erasable ink which is an erasable colorant may use a dye such as a leuco dye. Further, the erasable ink is erased at about 80 to 100° C. when heated.

The display panel 406 displays various pieces of information such as setting information for the image forming and erasing apparatus 100 or working states. The display panel 906 may be constituted by, for example, a sheet of electronic paper, an LCD (Liquid Crystal Display), an EL (Electronic Luminescence), a PDP (Plasma Display Panel), a CRT (Cathode Ray Tube), or the like. In addition, if the display panel 406 is constituted by a touch panel display, the display panel 406 can realize a portion or all of the function of the operation input unit 404.

The sheet supply unit 44 supplies a sheet such as paper on which an image is formed to the first image forming unit 42 or the second image forming unit 43. The sheet supply unit 44 in this embodiment includes a new sheet supply unit 44*a* which supplies a new sheet on which an image is not formed at all, a reuse sheet supply unit 44*b* which supplies a reuse sheet on which an image was formed using an erasable colorant but the image is erased for reuse through erasing, and an manual sheet supply unit 44*c*.

The facsimile apparatus 405 transmits and receives a facsimile signal in the image forming and erasing apparatus 100.

In addition, as described above, the paper post-processing apparatus 5 includes a sheet post-processing unit 51 which sorts the number of sheets which are set if the image forming apparatus 4 prints a plurality of sheets. However, even when a plurality of sheets is not printed, the sheet post-processing unit 51 can also function as a discharge portion which places a discharged sheet thereon.

In addition, the paper post-processing apparatus 5 includes the sheet carrying unit 24, the erasure processing unit 25, and the stand-by tray driving unit 26 in the same manner as the erasing apparatus 1 in the first embodiment, in addition to the sheet post-processing unit 51. The functions of the respective units are the same as in the first embodiment, and thus the detailed description thereof will be omitted. In addition, in this embodiment, the sheet carrying unit 24, the erasure processing unit 25, and the stand-by tray driving unit 26 are operated in cooperation with a processor (not shown) independently provided in the paper post-processing apparatus 5 side, the processor 401 of the image forming apparatus 4, and the like.

Next, the image erasing in the rewritable printing mode in the image forming and erasing apparatus 100 configured as described above will be described. Further, it is assumed that the used sheet P on which an image is formed using an erasable colorant is stacked on the used sheet stacking tray 10.

First, if an erasing request is input from a user through pressing of an operation input button (not shown), the processor 401 activates the sheet carrying unit 24, rotatably drives the used sheet carrying rollers 11, extracts the used sheets P stacked on the used sheet stacking tray 10 one by one, and carries the used sheet P to the image erasing unit 12.

Next, the processor 401 activates the erasure processing unit 25, makes the image erasing unit 12 perform the erasing process for the used sheet P so as to be discharged as the erased sheet P'. The image erasing unit 12 heats the used sheet P at a predetermined temperature so as to erase an image on the used sheet P, formed using an erasable colorant.

Then, the processor 401 activates the sheet carrying unit 24, rotatably drives the erased sheet carrying rollers 13, and carries the erased sheet P' from the image erasing unit 12 to the stand-by tray 14.

Next, the processor 401 activates the stand-by tray driving unit 26, and if the erased sheet F' is placed on the stand-by tray 14 and then a constant time has elapsed, drives the pair of tray members 14*a* and 14*b* outwardly in the transverse direction, and makes the erased sheet P' free-drop towards the erased sheet stacking tray 16. In addition, the pair of tray members 14*a* and 14*b* moves so as to make the erased sheet P' free-drop, and thereafter returns to the home position so as to receive the erased sheet P' again.

Further, the erased sheet stacking tray 16 receives the erased sheets P' which sequentially free-drop from the stand-by tray 14 and stacks them thereon.

Successively, an image forming process in the rewritable printing mode in the image forming and erasing apparatus 100 will be described.

First, if a user inputs an image forming request in the rewritable printing mode using the display panel 406 or the like, the processor 401 reads image data which is printed on a sheet by a scanner in the image reading unit 41 and stores the read image data in the memory 402.

Next, the processor 401 activates the sheet carrying unit 24 of the paper post-processing apparatus 5, rotatably drives the reuse sheet carrying rollers 17, extracts the erased sheets P' stacked on the erased sheet stacking tray 16 one by one, and carries the extracted erased sheet P' to the reuse sheet supply unit 44*b* of the image forming apparatus 4.

In addition, the processor 401 activates the reuse sheet supply unit 44*b* so as to supply the reuse sheet to the second image forming unit 43. The second image forming unit 43 forms an image using an erasable colorant, and sends the sheet to the paper post-processing apparatus 5 side as a used sheet.

In this way, according to the image forming and erasing apparatus 100 in this embodiment, since the image forming apparatus 4 and the paper post-processing apparatus 5 are integrally formed, it is possible to consecutively perform the generation of the reuse sheet by erasing an image formed on the used sheet P and the formation of an image on the reuse sheet. In addition, since a reuse sheet can be easily used, it is possible to suppress a new sheet from being wasted.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form the apparatus and methods described herein may be made without departing from the spirit of the inventions. The accompanying claims and their equivalents are intended to cover such forms of modifications as would fall within the scope and spirit of the invention.

What is claimed is:

1. An erasing apparatus comprising:

a used sheet stacking tray that stacks thereon a used sheet on which an image is formed using an erasable colorant of which a color is erased by a predetermined heating process;

an image erasing unit that performs the heating for the used sheet which is received from the used sheet stacking tray and discharges an erased sheet from which the image formed on the used sheet is erased;

a stand-by tray that has a mechanism driven in a predetermined direction and that places thereon the erased sheet discharged by the image erasing unit;

a stand-by tray driving unit that drives the stand-by tray and enables the erased sheet to drop; and an erased sheet stacking tray that is disposed under the stand-by tray and stacks thereon the erased sheet dropped from the stand-by tray.

2. The apparatus according to claim 1, wherein the stand-by tray includes a pair of tray members which is respectively formed extending from vicinities of the left end and the right end of a sheet discharge portion to a discharge direction.

3. The apparatus according to claim 2, wherein the stand-by tray driving unit slides the pair of tray members in a transverse direction and the erased sheet drops on the erased sheet stacking tray.

4. The apparatus according to claim 2, wherein the stand-by tray driving unit rotates the pair of tray members upwardly or downwardly by using support portions outside a sheet stacking surface as axes, and the erased sheet drops on the erased sheet stacking tray.

5. The apparatus according to claim 3, wherein the stand-by tray driving unit drives the pair of tray members after the erased sheet is stacked on the stand-by tray and then a predetermined time elapses.

6. The apparatus according to claim 4, wherein the stand-by tray driving unit drives the pair of tray members after the erased sheet is stacked on the stand-by tray and then a predetermined time elapses.

7. A paper post-processing apparatus comprising:

a post-processing mechanism that is connected to an image forming apparatus and performs a predetermined post-process for a used sheet on which an image is formed using an erasable colorant of which a color is erased by a predetermined heating process, by the image forming apparatus;

a used sheet stacking tray that stacks the used sheet thereon;

an image erasing unit that performs the heating for the used sheet which is received one by one from the used sheet stacking tray and discharges an erased sheet from which the image formed on the used sheet is erased;

a stand-by tray that has a mechanism which can be driven in a predetermined direction and that places thereon the erased sheet discharged by the image erasing unit;

a stand-by tray driving unit that drives the stand-by tray and enables the erased sheet to drop; and an erased sheet stacking tray that is disposed under the stand-by tray and stacks thereon the erased sheet which drops from the stand-by tray.

8. An image forming and erasing apparatus comprising:

an image data obtaining unit that obtains image data for forming an image on a sheet;

an image forming unit that forms an image based on the image data obtained by the image data obtaining unit on the sheet, using an erasable colorant of which a color is erased by a predetermined heating process or a non-erasable colorant of which a color is not erased by the heating process which erases the color of the erasable colorant;

a used sheet stacking tray that stacks thereon the sheet on which an image is formed in the image forming unit as a used sheet;

an image erasing unit that performs the heating for the used sheet which is received one by one from the used sheet stacking tray and discharges an erased sheet from which the image formed on the used sheet is erased;

a stand-by tray that has a mechanism which can be driven in a predetermined direction and that places thereon the erased sheet discharged by the image erasing unit;

a stand-by tray driving unit that drives the stand-by tray and enables the erased sheet to drop;

an erased sheet stacking tray that is disposed under the stand-by tray and stacks thereon the erased sheet which drops from the stand-by tray; and a reuse sheet supply unit that receives the erased sheet on the erased sheet stacking tray and supplies the received sheet to the image forming unit as a reuse sheet.

9. The apparatus according to claim 8, wherein the image forming unit includes:

a first image forming unit that forms the image on the sheet using the non-erasable colorant; and a second image forming unit that forms the image on the sheet using the erasable colorant.

10. The apparatus according to claim 9, wherein the stand-by tray includes a pair of tray members which is respectively formed extending from vicinities of the left end and the right end of an erased sheet discharge portion to a discharge direction.

11. The apparatus according to claim 10, wherein the stand-by tray driving unit slides the pair of tray members in a transverse direction and the erased sheet drops on the erased sheet stacking tray.

12. The apparatus according to claim 10, wherein the stand-by tray driving unit rotates the pair of tray members upwardly or downwardly by using support portions outside a sheet stacking surface as axes, and the erased sheet drops on the erased sheet stacking tray.

13. The apparatus according to claim 11, wherein the stand-by tray driving unit drives the pair of tray members after the erased sheet is stacked on the stand-by tray and then a predetermined time elapses.

14. The apparatus according to claim 12, wherein the stand-by tray driving unit drives the pair of tray members after the erased sheet is stacked on the stand-by tray and then a predetermined time elapses.

15. The apparatus according to claim 9, wherein the stand-by tray includes a pair of tray members which is respectively formed extending from vicinities of the left end and the right end of an erased sheet discharge portion to a discharge direction.

16. The apparatus according to claim 15, wherein the stand-by tray driving unit slides the pair of tray members in a transverse direction and the erased sheet drops on the erased sheet stacking tray.

17. The apparatus according to claim 15, wherein the stand-by tray driving unit rotates the pair of tray members upwardly or downwardly by using support portions outside a sheet stacking surface as axes, and the erased sheet drops on the erased sheet stacking tray.

18. The apparatus according to claim 16, wherein the stand-by tray driving unit drives the pair of tray members after the erased sheet is stacked on the stand-by tray and then a predetermined time elapses.

19. The apparatus according to claim 17, wherein the stand-by tray driving unit drives the pair of tray members after the erased sheet is stacked on the stand-by tray and then a predetermined time elapses.

20. An image erasing method in an erasing apparatus comprising:

causing used sheet carrying rollers to receive a used sheet on which an image formed using an erasable colorant of which a color is erased by a predetermined heating process, one by one from a used sheet stacking tray;

causing an image erasing unit to heat the used sheet received;

causing erased sheet carrying rollers to discharge the used sheet from which an image is erased by the heating from the image erasing unit;

causing a stand-by tray having a mechanism capable of being driven in a predetermined direction to place the erased sheet discharged; and causing a stand-by tray driving unit to drive the stand-by tray after a predetermined time elapses since the erased sheet is placed, such that the erased sheet drops towards on an erased sheet stacking tray disposed under the stand-by tray and the erased sheet is stacked on the erased sheet stacking tray.

* * * * *